US011753906B2

(12) United States Patent
Gharesi et al.

(10) Patent No.: US 11,753,906 B2
(45) Date of Patent: Sep. 12, 2023

(54) BALL SEAT RELEASE APPARATUS INCLUDING SLIDING SHEAR SLEEVE

(71) Applicant: Halliburton Energy Services, Inc., Houston, TX (US)

(72) Inventors: Abdolreza Gharesi, Southlake, TX (US); Alan Tancel Jackson, Frisco, TX (US); Richard Paul Noffke, Frisco, TX (US); Stephen Maddux, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 174 days.

(21) Appl. No.: 17/131,442

(22) Filed: Dec. 22, 2020

(65) Prior Publication Data

US 2022/0195843 A1 Jun. 23, 2022

(51) Int. Cl.
*E21B 34/14* (2006.01)
*E21B 23/03* (2006.01)

(52) U.S. Cl.
CPC ..... *E21B 34/142* (2020.05); *E21B 23/03* (2013.01)

(58) Field of Classification Search
CPC ..... E21B 34/142; E21B 23/03; E21B 2200/06
See application file for complete search history.

(56) References Cited

U.S. PATENT DOCUMENTS

2010/0122817 A1* 5/2010 Surjaatmadja ..... E21B 34/14 166/308.1
2011/0114334 A1* 5/2011 Palacios ..... E21B 23/04 166/373
2011/0203809 A1* 8/2011 Knobloch, Jr. ..... E21B 21/103 166/334.1
2016/0108716 A1* 4/2016 Brown-Kerr ..... E21B 47/18 166/250.01
2017/0175487 A1* 6/2017 Marcin ..... E21B 34/14
2018/0320478 A1* 11/2018 Themig ..... E21B 43/16

FOREIGN PATENT DOCUMENTS

EP 2941531 B1 5/2018
WO 2004106694 A1 12/2004

* cited by examiner

*Primary Examiner* — Christopher J Sebesta
(74) *Attorney, Agent, or Firm* — Scott Richardson; Parker Justiss, P.C.

(57) ABSTRACT

Provided, in one aspect, is a ball seat release apparatus. The ball seat release apparatus, according to this embodiment, includes a shear sleeve having a recess pocket and a ball seat body slidingly engaged within the shear sleeve, the ball seat body configured to move from a first linear position to a second linear position. The ball seat body further includes a longitudinal fluid passageway, a ball seat located in the longitudinal fluid passageway, one or more first fluid bypass ports coupling the longitudinal fluid passageway and an exterior of the ball seat body, the one or more first fluid bypass ports located on a first side of the ball seat, and one or more second fluid bypass ports coupling the longitudinal fluid passageway and the exterior of the ball seat body, the one or more second fluid bypass ports located on a second opposing side of the ball seat.

20 Claims, 7 Drawing Sheets

BALL SEAT RELEASE APPARATUS INCLUDING SLIDING SHEAR SLEEVE

BACKGROUND

In conventional practice, the drilling of an oil or gas well involves creating a wellbore that traverses numerous subterranean formations. For a variety reasons, each of the formations through which the well passes is preferably sealed. For example, it is important to avoid an undesirable passage of formation fluids, gases or materials from the formations into the wellbore or for wellbore fluids to enter the formations. In addition, it is commonly desired to isolate producing formations from one another and from nonproducing formations.

Accordingly, conventional well architecture often includes the installation of casing within the wellbore. In addition to providing the sealing function, the casing also provides wellbore stability to counteract the geomechanics of the formation such as compaction forces, seismic forces and tectonic forces, thereby preventing the collapse of the wellbore wall. The casing is generally fixed within the wellbore by a cement layer that fills the annulus between the outer surface of the casing and the wall of the wellbore. For example, once a casing string is located in its desired position in the well, a cement slurry is pumped via the interior of the casing, around the lower end of the casing and upward into the annulus. After the annulus around the casing is sufficiently filled with the cement slurry, the cement slurry is allowed to harden, thereby supporting the casing and forming a substantially impermeable barrier.

In standard practice, the wellbore is drilled in intervals with casing installed in each interval before the next interval is drilled. As such, each succeeding casing string placed in the wellbore typically has an outside diameter having a reduced size when compared to the previously installed casing string. Specifically, a casing to be installed in a lower wellbore interval must be passed through the previously installed casing strings in the upper wellbore intervals. In one approach, each casing string extends downhole from the surface such that only a lower section of each casing string is adjacent to the wellbore wall. Alternatively, the wellbore casing strings may include one or more liner strings, which do not extend to the surface of the wellbore, but instead typically extend from near the bottom end of a previously installed casing string downward into the uncased portion of the wellbore. In such installations, the liner string may be set or suspended from a liner hanger positioned between the downhole end of the previously installed casing string and an uphole end of the liner string.

BRIEF DESCRIPTION

Reference is now made to the following descriptions taken in conjunction with the accompanying drawings, in which.

DETAILED DESCRIPTION

Downhole equipment is often installed/activated using hydraulic pressure. The pressure is generated by closing the internal diameter ("ID") of the string and pumping the close volume until the activation pressure for the downhole equipment is achieved. For liner hanger installation, a setting ball is typically used to close the running tool ID and pressure is applied inside the drill string to set the hanger and release the running tool.

In some application, there is a requirement to re-establish the circulation after the liner hanger is set, particularly when expandable liner hangers are used. This requires removing and/or bypassing the ball. A typical hydraulically activated tool will require high pressure to release the ball to open the tubing ID. This pressure can cause a pressure shock to the formation when it is released below the running tool, possibly damaging the formation. A liner hanger designed, manufactured and operated according to the disclosure employs a soft ball seat release apparatus, which allows for re-establishing the flow path without exceeding the normal circulation pressure.

Figure 1:
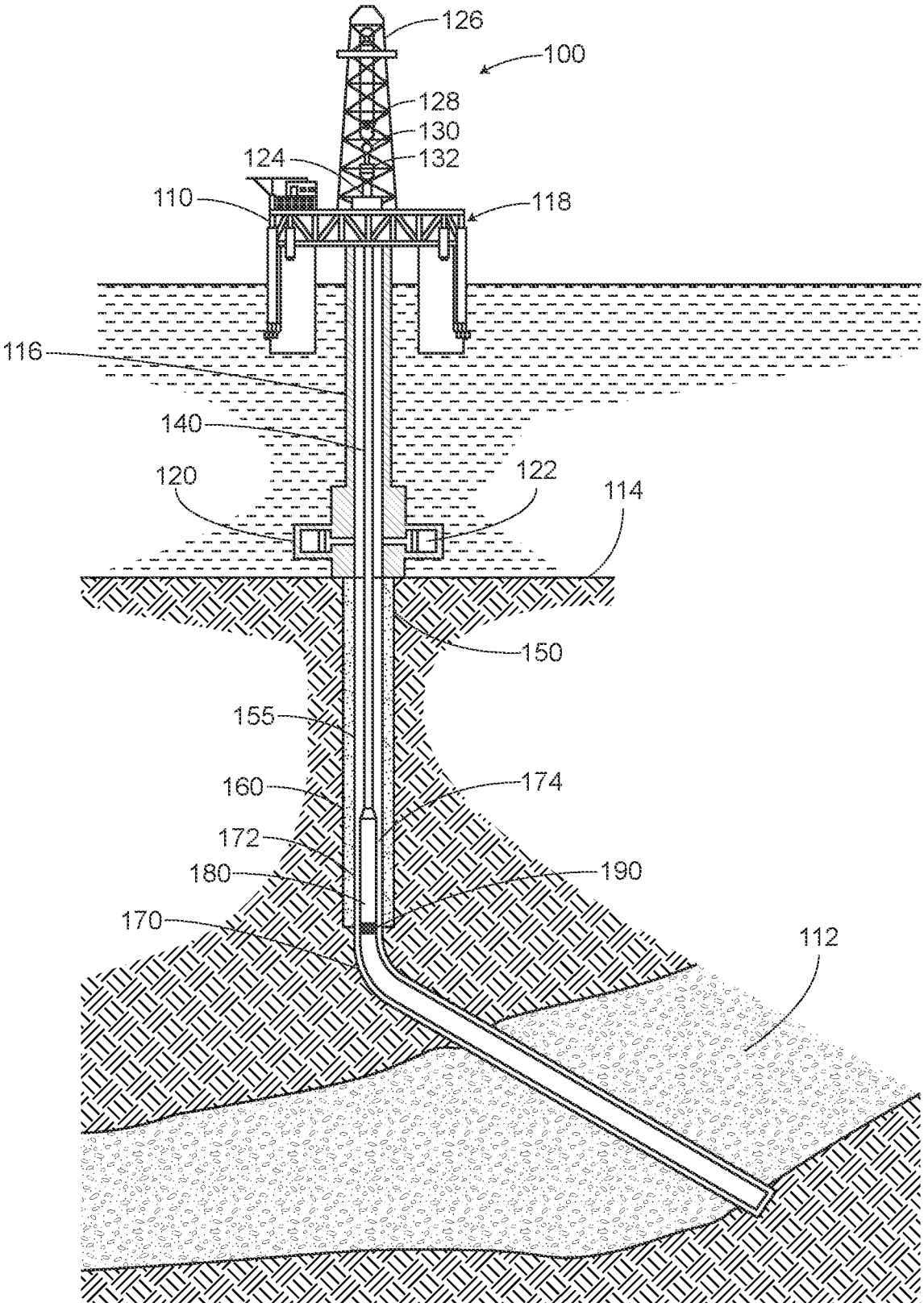
FIG. 1 illustrates a well system designed, manufactured and operated according to the disclosure.

Referring initially to FIG. 1, illustrated is a well system 100 designed, manufactured and operated according to the disclosure. The well system 100, in one embodiment, employs a ball seat release apparatus (e.g., soft release) 190 also designed, manufactured and operated according to the disclosure. In the well system 100, a semi-submersible platform 110 is centered over a submerged oil and gas formation 112 located below sea floor 114. A subsea conduit 116 extends from deck 118 of platform 110 to wellhead installation 120, including blowout preventers 122. Platform 110 has a hoisting apparatus 124, a derrick 126, a travel block 128, a hook 130 and a swivel 132 for raising and lowering a downhole conveyance 140, including without limitation pipe strings, a work string, etc.

A wellbore 150 has been drilled in sections through the various earth strata, including formation 112. A casing string 155 is secured within an upper portion of wellbore 150 by cement 160. The term "casing" is used herein to designate a tubular string operable to be positioned in a wellbore, for example to provide wellbore stability. The casing may be of the type known to those skilled in the art as a "liner" and may be made of any material, such as steel or a composite material. The casing may be a jointed tubular string or a continuous tubular string. Extending downhole from casing string 155 into a lower portion of wellbore 150 is a liner string 170 that includes at its upper end, a liner hanger 172 and a liner top 174.

The ball seat release apparatus (e.g., soft release) 190, in the illustrated embodiment, is coupled to the downhole conveyance 140 and running tool 180. In accordance with the disclosure, the ball seat release apparatus 190 allows for re-establishing the flow path below the running tool 180, for example without removing the running tool 180 from the wellbore 150, and also without exceeding the normal circulation pressure. Accordingly, the flow path may be re-established without a pressure shock to the formation.

Even though FIG. 1 depicts a liner string 170 being installed in a slanted wellbore, it should be understood by those skilled in the art that the present system is equally well suited for use in wellbores having other orientations including vertical wellbores, horizontal wellbores, deviated wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the present system is equally well suited for use in onshore operations.

Figure 2:
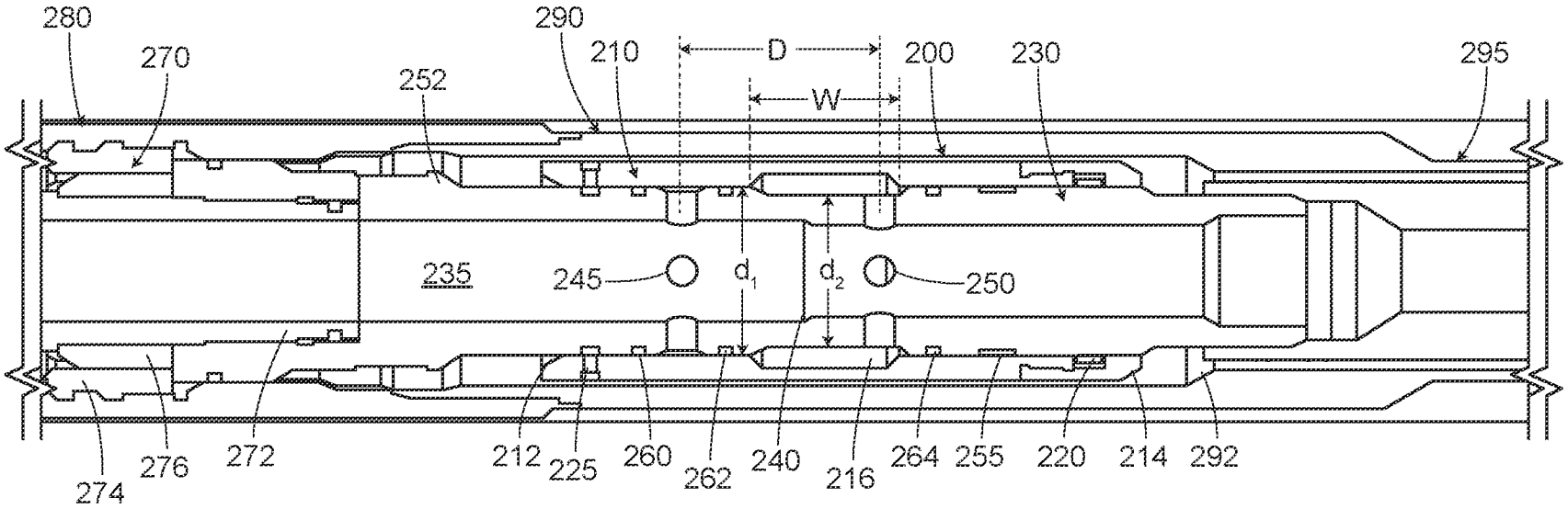
FIG. 2 illustrates a ball seat release apparatus designed, manufactured and operated according to the disclosure.

Turning to FIG. 2, illustrated is a cross-sectional view of a ball seat release apparatus 200 designed, manufactured and operated according to the disclosure. The ball seat release apparatus 200, in the illustrated embodiment, has been run downhole on a running tool 270. In the illustrated embodiment, the ball seat release apparatus 200 and running tool 270 are positioned within a liner hanger 280, a crossover sub 290, and a liner string 295. Those skilled in the art appreciate that an opposite end of the liner hanger 280 would be coupled to a casing string, such that the liner hanger 280 anchors and seals the liner string 295 from the casing string.

The running tool 270, in the illustrated embodiment, includes a tool string 272 that extends uphole toward a surface of the wellbore. The running tool 270, in the illustrated embodiment, additionally includes a collet 274, as well as a collet support 276. The collet 274, as illustrated, may have a collet profile that engages a related profile in a bottom end of the liner hanger 280. Thus, as the running tool 270 is moved downhole, and the collet profile of the collet 274 engages the profile in the liner hanger 280, the collet 274 will remain fixed while the liner hanger 280 is set with the casing string.

The ball seat release apparatus 200, in the illustrated embodiment of FIG. 2, includes a shear sleeve 210. The shear sleeve 210, in one or more embodiments (e.g., including the embodiment of FIG. 2) includes a first shoulder 212 and a second shoulder 214. In the illustrated embodiment, the first shoulder 212 is an uphole shoulder, and the second shoulder 214 is a downhole shoulder. In accordance with one embodiment, the first shoulder 212 is engageable with another feature in the ball seat release apparatus 200 (e.g., shoulder 252 of the ball seat body 230), whereas the second shoulder 214 is engageable with a shoulder 292 in the crossover sub 290. Accordingly, in the embodiment of FIG. 2, the shear sleeve 210 is a sliding shear sleeve operable to slide (e.g., slide downhole in one embodiment) until the second shoulder 214 engages with the shoulder 292.

The shear sleeve 210, in the illustrated embodiment, additionally includes a first recess pocket 216 formed along at least a portion of an inner surface thereof. The first recess pocket 216, in one or more embodiments, is a fluid bypass recess pocket. In accordance with one or more embodiments, the first recess pocket 216 includes a width (W). The width (W) may vary greatly and remain within the scope of the disclosure. Nevertheless, in one or more embodiments the width (W) ranges from about 4 cm to about 20 cm. In one or more other embodiments the width (W) ranges from about 6 cm to about 16 cm, and in one or more other embodiments the width (W) ranges from about 8 cm to about 10 cm. The shear sleeve 210, in the illustrated embodiment of FIG. 2, additionally includes a locking snap feature 220. The locking snap feature 220 may comprise many different locking features and remain within the scope of the disclosure. Nevertheless, the locking snap feature 220 is a snap ring in the embodiment of FIG. 2.

The ball seat apparatus 200 illustrated in FIG. 2 additionally includes a ball seat body 230 slidingly engaged within the shear sleeve 210. In one or more embodiments, the ball seat body 230 is configured to move from a first linear position to a second linear position in relation to the shear sleeve 210. In certain embodiments, the first linear position is a first uphole linear position, and the second linear position is a second downhole linear position. Nevertheless, other embodiments exist wherein this orientation is reversed.

In the illustrated embodiment of FIG. 2, the ball seat body 230 and the shear sleeve 210 are releasably coupled using a shear feature 225. The shear feature 225, in one embodiment, is a shear pin located in the shear sleeve 210 and engaged with the ball seat body 230. Nevertheless, other shear features 225 are within the scope of the disclosure.

The ball seat body 230, in one or more embodiments, includes a longitudinal fluid passageway 235, as well as a ball seat 240 located within the longitudinal fluid passageway 235. As those skilled in the art appreciate, the ball seat 240 is configured to engage with a drop ball or plug, such that the drop ball or plug may seat against the ball seat 240. With the drop ball or plug seated against the ball seat 240, an operator of the ball seat apparatus 200 may pressure up on the drop ball or plug to set the liner hanger 280 and fix the liner string relative to the casing string.

The ball seat body 230, in one or more embodiments, may additionally include one or more first fluid bypass ports 245 coupling the longitudinal fluid passageway 235 and an exterior of the ball seat body 230. In the embodiment shown, the one or more first fluid bypass ports 245 are located on a first side of the ball seat 240. For example, the one or more first fluid bypass ports 245 may be located on an uphole side of the ball seat 240 in certain embodiments. The ball seat body 230, in one or more embodiments, may additionally include one or more second fluid bypass ports 250 coupling the longitudinal fluid passageway 235 and the exterior of the ball seat body 230. In the embodiment shown, the one or more second fluid bypass ports 250 are located on a second side of the ball seat 240. For example, the one or more second fluid bypass ports 250 may be located on a downhole side of the ball seat 240 in certain embodiments.

In accordance with one or more embodiments, the one or more first fluid bypass ports 245 and the one or more second fluid bypass ports 250 may be separated by a distance (D). The distance (D) may vary greatly and remain within the scope of the disclosure. Nevertheless, in one or more embodiments the distance (D) ranges from about 8 cm to about 20 cm. In one or more other embodiments the distance (D) ranges from about 10 cm to about 13 cm. In certain other embodiments, the distance (D) is greater than a width (W) of the first recess pocket 216.

In certain embodiments, an outside diameter (d) of the ball seat body 230 may vary across a length thereof. For example, in the embodiment of FIG. 2, the ball seat body 230 has a first outer diameter ($d_1$) proximate the one or more first fluid bypass ports 245 and a second lesser outer diameter ($d_2$) proximate the one or more second fluid bypass ports 250. The specific values for the first outer diameter ($d_1$) and the second lesser outer diameter ($d_2$) may vary greatly and remain within the scope of the disclosure.

The ball seat body 230, in one or more embodiments, includes a shoulder 252 that is engageable with the first shoulder 212 in the shear sleeve 210. In this embodiment, once the shear feature 225 has been sheared, the ball seat body 230 may continue to slide relative to the shear sleeve 210 until the shoulder 252 engages with the first shoulder 212. At this point, the ball seat body 230 would be located in the second linear position.

The ball seat body 230, in the illustrated embodiment, additionally includes a second recess pocket 255 located along a portion of an outer surface thereof. The second recess pocket 255, in at least one embodiment is configured to align with the locking snap feature 220. Accordingly, when appropriately placed, the locking snap feature 220 is configured to radially retract into the second recess pocket 255 to lock the ball seat body 230 and the shear sleeve 210 relative to one another. For example, this locking may occur when the ball seat body 230 is in the second linear position.

The ball seat release apparatus 200 illustrated in the embodiment of FIG. 2 additionally includes a first circumferential seal 260 located between the sheer sleeve 210 and the ball seat body 230. In one embodiment, the first circumferential seal 260 is positioned proximate and uphole of the one more or more first fluid bypass ports 245. The ball seat release apparatus 200 illustrated in the embodiment of FIG. 2 may additionally include a second circumferential seal 262 located between the sheer sleeve 210 and the ball seat body 230. In one embodiment, the second circumferential seal 262 is positioned proximate and downhole of the one more or more first fluid bypass ports 245, but uphole of the one more or more second fluid bypass ports 250. The ball seat release apparatus 200 illustrated in the embodiment of FIG. 2 may additionally include a third circumferential seal 264 located between the sheer sleeve 210 and the ball seat body 230. In one embodiment, the third circumferential seal 264 is positioned proximate and downhole of the one more or more second fluid bypass ports 250.

In one embodiment of the operation of the ball seat release apparatus 200 of FIG. 2, the one or more first fluid bypass ports 245 do not radially align with the first recess pocket 216 when the ball seat body 230 is in the first linear position, but the one or more second fluid bypass ports 250 do radially align with the first recess pocket 216 when the ball seat body 230 is in the first linear position. Additionally, in this embodiment of the operation of the ball seat release apparatus 200 of FIG. 2, the one or more first fluid bypass ports 245 do radially align with the first recess pocket 216 when the ball seat body 230 is in the second linear position, but the one or more second fluid bypass ports 250 do not radially align with the first recess pocket 216 when the ball seat body 230 is in the second linear position. In other embodiments, however, the one or more second fluid bypass ports 250 radially align with the first recess pocket 216 when the ball seat body 230 is in the second linear position. Such a configuration allows the one or more first fluid bypass ports 245, the first recess pocket 216, and the one or more second fluid bypass ports 250 to provide a fluid flow path around a drop ball or plug engageable with the ball seat 240 when the ball seat body 230 is in the second linear position, but close the fluid flow path when the ball seat body 230 is in the first linear position.

Figure 3:
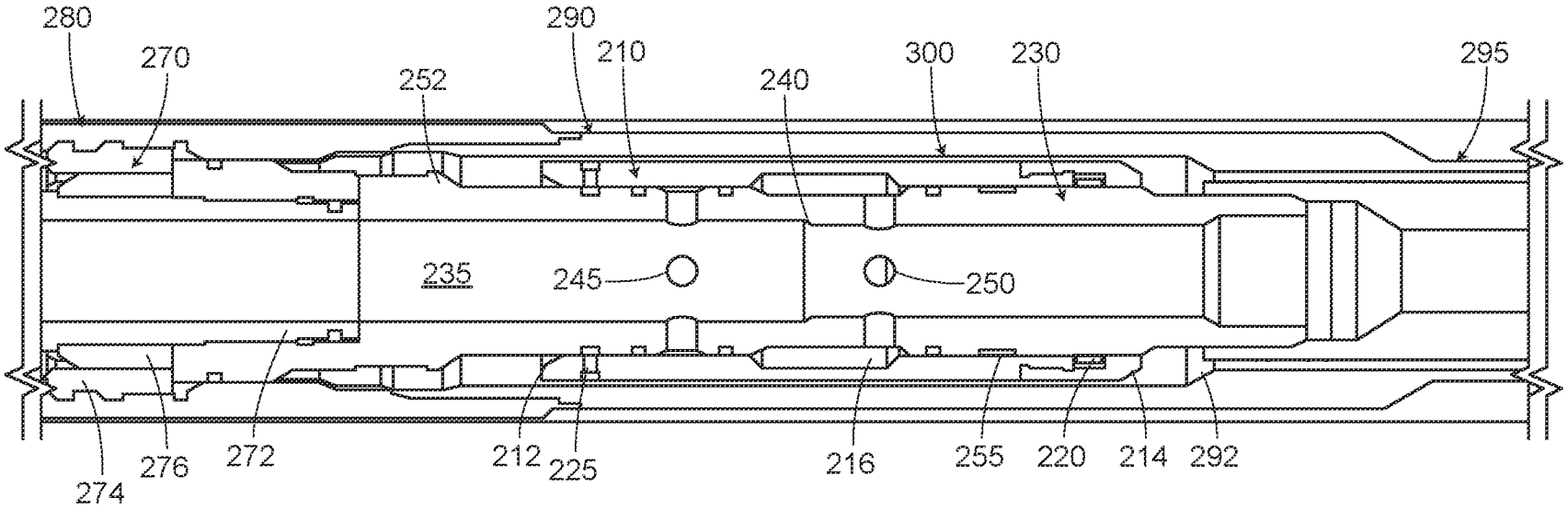
FIGS. 3-7 illustrate various different operational states of the ball seat release apparatus illustrated in FIG. 2.

Turning now to FIGS. 3-7, illustrated are various different partial cross-sectional views of the ball seat release apparatus 300 at different operational states within the liner hanger 280, crossover sub 290 and liner string 295. The ball seat release apparatus 300 is similar in many respects to the ball seat release apparatus 200 illustrated in FIG. 2. Accordingly, like reference numbers have been used to illustrate similar, if not identical, amongst the two. The ball seat release apparatus 300 is illustrated in FIG. 3 in its run-in-hole operational state. Accordingly, the ball seat release apparatus 300 is coupled to the running tool 270. Moreover, the shear feature 225 is fixing the shear sleeve 210 to the ball seat body 230. Accordingly, the ball seat body 230 is held in a first linear position relative to the shear sleeve 210. The first linear position, in the embodiment of FIG. 3, is an uphole linear position. Accordingly, a fluid bypass path through the one or more first fluid bypass ports 245, the first recess pocket 216 and the one or more second fluid bypass ports 250 is closed.

Figure 4:
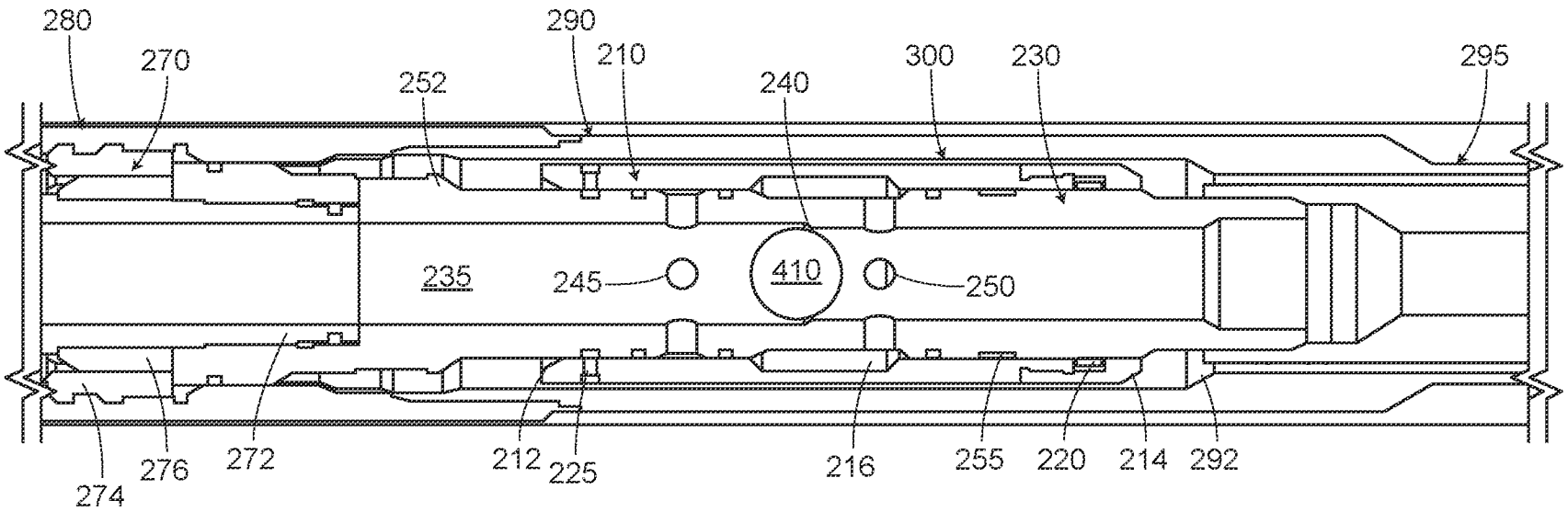

Turning to FIG. 4, illustrated is the ball seat release apparatus of FIG. 3 after deploying a drop ball or plug 410 with the running tool 270. The drop ball or plug 410, in the illustrated embodiment, seats with the ball seat 240. With the drop ball or plug 410 seated with the ball seat 240, the running tool 270 and ball seat release apparatus 300 may be subjected to one or more pressure cycles. The pressure cycles, in this embodiment, set the liner hanger 280, for example by driving a cone that radially expands the liner hanger 280 in engagement with the uphole casing string. At this stage, the liner hanger 280 fixes the liner string 295 with the casing string. At this stage, the shear sleeve 210 and the ball seat body 230 are still located in their respective first linear positions (e.g., first uphole positions).

Figure 5:
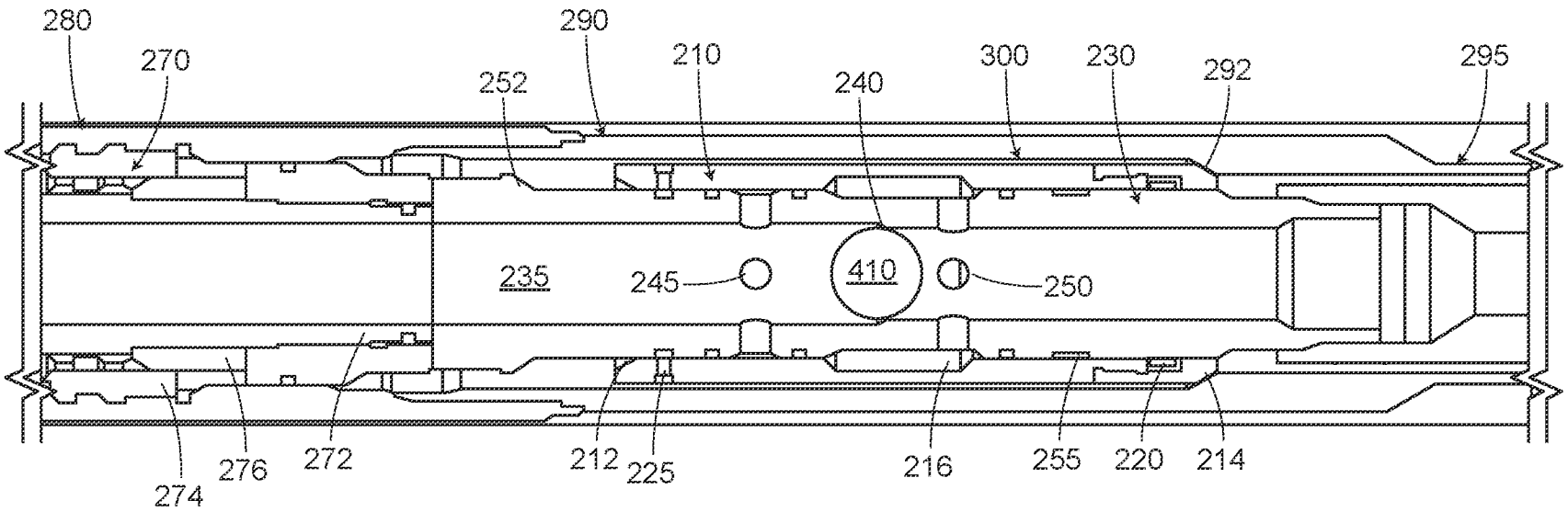

Turning to FIG. 5, illustrated is the ball seat release apparatus of FIG. 4 after setting weight down on the ball seat release apparatus 300 via the running tool 270. As shown, the running tool 270 pushes the entire ball seat release apparatus 300 downhole until the shoulder 214 on the shear sleeve 210 engages the shoulder 292 on the crossover sub 290. Accordingly, the shear sleeve 210 is prevented from moving any further downhole. Thus, the shear sleeve 210 is operable to move from a first linear position (e.g., that shown in FIG. 4) to a second linear position (e.g., that shown in FIG. 5). At this stage, the shear sleeve 210 is its second linear position, but the ball seat body 230 is still in the first linear position.

Figure 6:
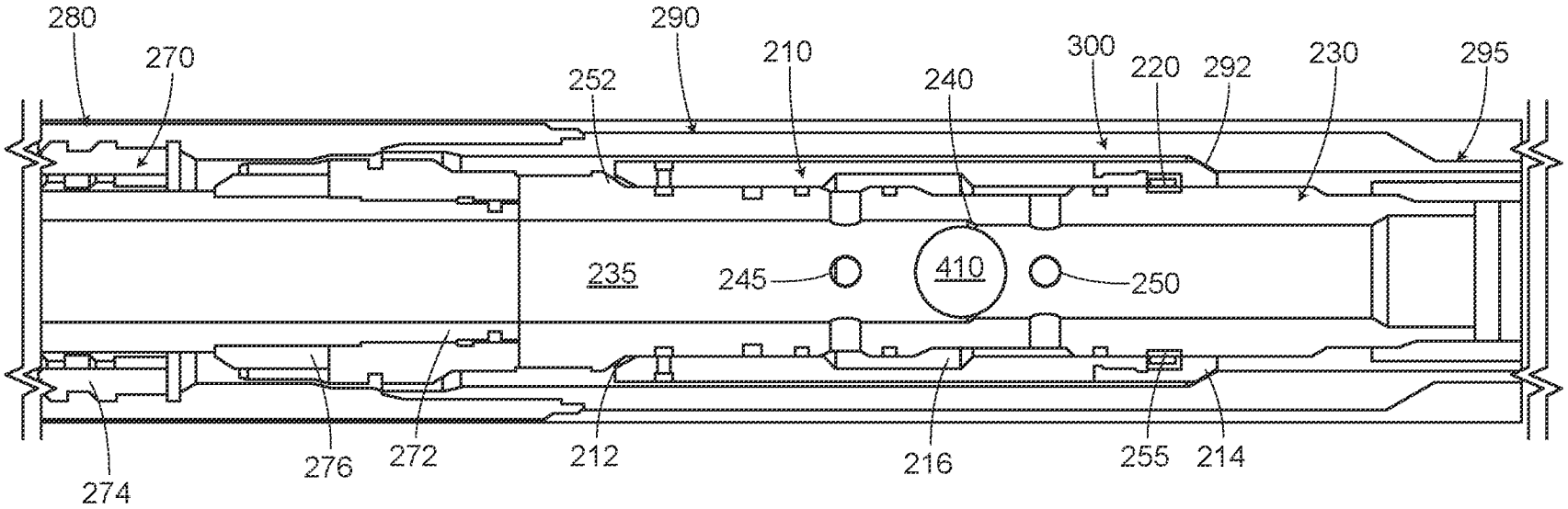

Turning to FIG. 6, illustrated is the ball seat release apparatus 300 of FIG. 5, after continuing to set weight down on the ball seat release apparatus 300 via the running tool. As the shear sleeve 210 is unable to move further, the ball seat body 230 continues to move downhole, thereby shearing the shear feature 225. At this stage, the ball seat body 230 is able to move relative to the shear sleeve 210. Accordingly, as the ball seat body 230 continues to move downhole, the shoulder 252 of the ball seat body 230 engages the shoulder 212 of the shear sleeve 210. At this stage, the shear sleeve 210 and the ball seat body 230 are located in their respective second linear positions (e.g., second uphole positions). In the illustrated embodiment of FIG. 6, the locking snap feature 220 has radially retracted into the second recess pocket 255 to lock the ball seat body 230 and the shear sleeve 210 relative to one another. For example, this locking may occur when the ball seat body 230 is in the second linear position, as shown.

Figure 7:
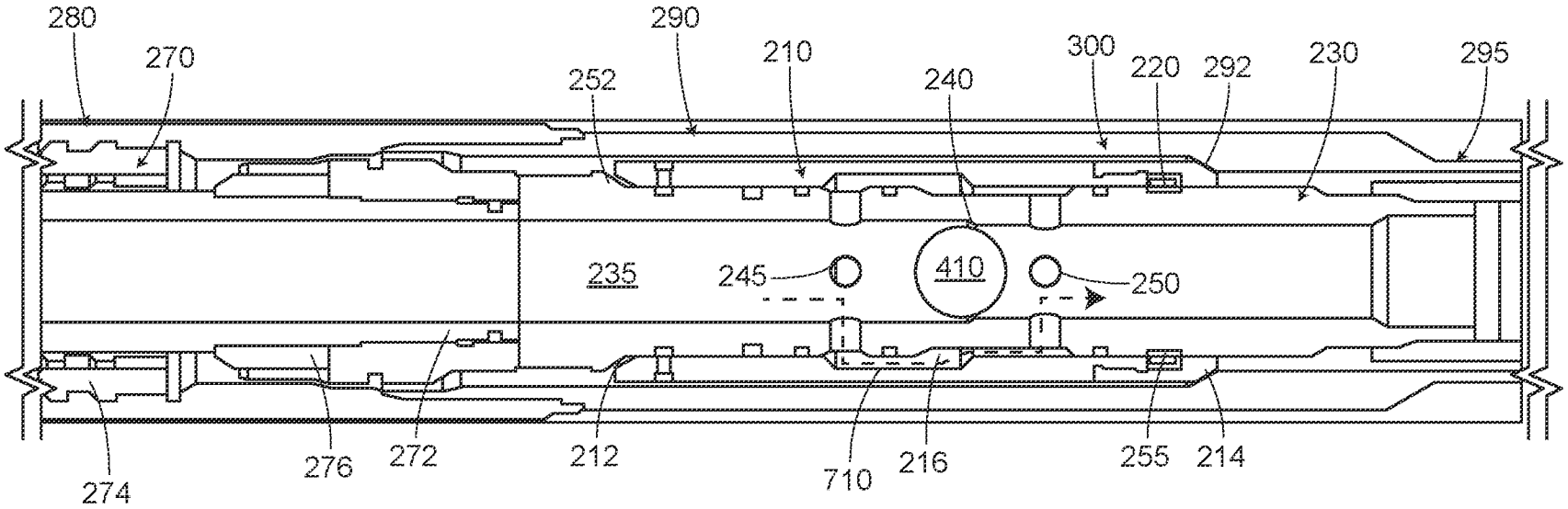

Turning to FIG. 7, illustrated is the ball seat release apparatus 300 of FIG. 6, after fluid (e.g., low pressure fluid) is pumped down the running tool 270. As shown, the fluid may bypass the drop ball or plug 410 via the flow path 710. For example, with the ball seat body 230 in the second linear position, the fluid may bypass the drop ball or plug 410 by exiting the ball seat body 230 via the one or more first bypass ports 245, traversing along the first recess pocket 216, and then entering back into the ball seat body 230 via the one or more second bypass ports 250. In this embodiment, the drop ball or plug 410 remains seated against the ball seat 240, and thus the full ID of the tool is not accessible for fluid flow, however, the flow path 710 is re-established without a pressure shock to the formation.

Aspects disclosed herein include:

A. A ball seat release apparatus, the ball seat release apparatus including: 1) a shear sleeve, the shear sleeve having a recess pocket located along a portion of an inner surface thereof, 2) a ball seat body slidingly engaged within the shear sleeve, the ball seat body configured to move from a first linear position to a second linear position in relation to the shear sleeve, and further wherein a shear feature releasably couples the ball seat body with the shear sleeve, the ball seat body including: a) a longitudinal fluid passageway; b) a ball seat located in the longitudinal fluid passageway; c) one or more first fluid bypass ports coupling the longitudinal fluid passageway and an exterior of the ball seat body, the one or more first fluid bypass ports located on a first side of the ball seat; and d) one or more second fluid bypass ports coupling the longitudinal fluid passageway and the exterior of the ball seat body, the one or more second fluid bypass ports located on a second opposing side of the ball seat.

B. A well system, the well system including: 1) a casing string secured within a wellbore extending through one or more subterranean formations, 2) a liner hanger and liner string suspended from and proximate a downhole end of the casing string, and 3) a ball seat release apparatus coupled proximate a downhole end of a running tool, and positioned within at least a portion of the liner hanger or liner string, the ball seat release apparatus including: a) a shear sleeve, the shear sleeve having a recess pocket located along a portion of an inner surface thereof; and b) a ball seat body slidingly engaged within the shear sleeve, the ball seat body configured to move from a first linear position to a second linear position in relation to the shear sleeve, and further wherein a shear feature releasably couples the ball seat body with the shear sleeve, the ball seat body including: i) a longitudinal fluid passageway; ii) a ball seat located in the longitudinal fluid passageway; iii) one or more first fluid bypass ports coupling the longitudinal fluid passageway and an exterior of the ball seat body, the one or more first fluid bypass ports located on a first side of the ball seat; and iv) one or more second fluid bypass ports coupling the longitudinal fluid passageway and the exterior of the ball seat body, the one or more second fluid bypass ports located on a second opposing side of the ball seat.

C. A method for completing a well system, the method including: 1) deploying a liner hanger and liner string within a casing string using a running tool, wherein a ball seat release apparatus is coupled proximate a downhole end of the running tool, the ball seat release apparatus including: a) a shear sleeve, the shear sleeve having a recess pocket located along a portion of an inner surface thereof; and b) a ball seat body slidingly engaged within the shear sleeve, the ball seat body configured to move from a first linear position to a second linear position in relation to the shear sleeve, and further wherein a shear feature releasably couples the ball seat body with the shear sleeve, the ball seat body including: i) a longitudinal fluid passageway; ii) a ball seat located in the longitudinal fluid passageway; iii) one or more first fluid bypass ports coupling the longitudinal fluid passageway and an exterior of the ball seat body, the one or more first fluid bypass ports located on a first side of the ball seat; and iv) one or more second fluid bypass ports coupling the longitudinal fluid passageway and the exterior of the ball seat body, the one or more second fluid bypass ports located on a second opposing side of the ball seat: 2) positioning the liner hanger proximate a downhole end of the casing string; 3) placing a drop ball or plug within the casing string, the drop ball or plug seating against the ball seat; and 4) pressuring up on the drop ball or plug seated against the ball seat to set the liner hanger and fix the liner string relative to the casing string, and then moving the running tool downhole to move the ball seat body from the first linear position to the second linear position and provide a fluid path downhole of the ball seat release apparatus.

Aspects A, B, and C may have one or more of the following additional elements in combination: Element 1: wherein the shear sleeve includes a locking snap feature. Element 2: wherein the recess pocket is a first recess pocket, and further wherein the ball seat body includes a second recess pocket located along a portion of an outer surface thereof, the locking snap feature configured to radially retract into the second recess pocket to lock the ball seat body and the shear sleeve relative to one another when the ball seat body is in the second linear position. Element 3: wherein the locking snap features is a snap ring. Element 4: wherein the recess pocket, one or more first fluid bypass ports, and one or more second fluid bypass ports are configured to provide a fluid flow path around a drop ball or plug engageable with the ball seat when the ball seat body is in the second linear position. Element 51: wherein a distance (D) between the one or more first fluid bypass ports and the one or more second fluid bypass ports is greater than a width (W) of the recess pocket. Element 6: wherein the ball seat body has a first outer diameter ($d_1$) proximate the one or more first fluid bypass ports and a second lesser outer diameter ($d_2$) proximate the one or more second fluid bypass ports. Element 7: wherein the one or more first fluid bypass ports do not radially align with the recess pocket when the ball seat body is in the first linear position, but the one or more second fluid bypass ports do radially align with the recess pocket when the ball seat body is in the first linear position, and the one or more first fluid bypass ports do radially align with the recess pocket when the ball seat body is in the second linear position, but the one or more second fluid bypass ports do not radially align with the recess pocket when the ball seat body is in the second linear position. Element 8: wherein the shear sleeve is a sliding sheer sleeve. Element 9: further including a first circumferential seal located between the sheer sleeve and the ball seat body proximate and uphole of the one more or more first fluid bypass ports, a second circumferential seal located between the sheer sleeve and the ball seat body proximate and downhole of the one more or more first fluid bypass ports, and a third circumferential seal located between the sheer sleeve and the ball seat body proximate and downhole of the one more or more second fluid bypass ports. Element 10: wherein moving the running tool downhole to move the ball seat body from the first linear position to the second linear position includes moving the shear sleeve and the ball seat body downhole until a shoulder of the shear sleeve engages with a shoulder of a crossover sub, the shear sleeve and ball seat body linearly coupled with one another via the shear feature and continuing to move the ball seat body downhole until the shear feature shears and allows the ball seat body to move from the first linear position to the second linear position. Element 11: wherein continuing to move the ball seat body downhole until the shear feature shears and allows the ball seat body to move from the first linear position to the second linear position, includes aligning the one or more first fluid bypass ports with the recess pocket.

Those skilled in the art to which this application relates will appreciate that other and further additions, deletions, substitutions and modifications may be made to the described embodiments.

What is claimed is:

1. A ball seat release apparatus, comprising:

a shear sleeve, the shear sleeve having a recess pocket located along a portion of an inner surface thereof, the shear sleeve further including a downhole shoulder configured to engage with a shoulder in a crossover sub the shear sleeve is configured to slide within; and a ball seat body slidingly engaged within the shear sleeve, the ball seat body configured to move from a first linear position to a second linear position in relation to the shear sleeve, and further wherein a shear feature releasably couples the ball seat body with the shear sleeve, the ball seat body including:

a longitudinal fluid passageway;

a ball seat located in the longitudinal fluid passageway;

one or more first fluid bypass ports coupling the longitudinal fluid passageway and an exterior of the ball seat body, the one or more first fluid bypass ports located on a first side of the ball seat; and one or more second fluid bypass ports coupling the longitudinal fluid passageway and the exterior of the ball seat body, the one or more second fluid bypass ports located on a second opposing side of the ball seat.

2. The ball seat release apparatus as recited in claim 1, wherein the shear sleeve includes a locking snap feature.

3. The ball seat release apparatus as recited in claim 2, wherein the recess pocket is a first recess pocket, and further wherein the ball seat body includes a second recess pocket located along a portion of an outer surface thereof, the locking snap feature configured to radially retract into the second recess pocket to lock the ball seat body and the shear sleeve relative to one another when the ball seat body is in the second linear position.

4. The ball seat release apparatus as recited in claim 2, wherein the locking snap features is a snap ring.

5. The ball seat release apparatus as recited in claim 1, wherein the recess pocket, one or more first fluid bypass ports, and one or more second fluid bypass ports are configured to provide a fluid flow path around a drop ball or plug engageable with the ball seat when the ball seat body is in the second linear position.

6. The ball seat release apparatus as recited in claim 5, wherein a distance (D) between the one or more first fluid bypass ports and the one or more second fluid bypass ports is greater than a width (W) of the recess pocket.

7. The ball seat release apparatus as recited in claim 6, wherein the ball seat body has a first outer diameter ($d_1$) proximate the one or more first fluid bypass ports and a second lesser outer diameter ($d_2$) proximate the one or more second fluid bypass ports.

8. The ball seat release apparatus as recited in claim 7, wherein the one or more first fluid bypass ports do not radially align with the recess pocket when the ball seat body is in the first linear position, but the one or more second fluid bypass ports do radially align with the recess pocket when the ball seat body is in the first linear position, and the one or more first fluid bypass ports do radially align with the recess pocket when the ball seat body is in the second linear position, but the one or more second fluid bypass ports do not radially align with the recess pocket when the ball seat body is in the second linear position.

9. The ball seat release apparatus as recited in claim 1, wherein the shear sleeve is a sliding sheer sleeve.

10. The ball seat release apparatus as recited in claim 1, further including a first circumferential seal located between the sheer sleeve and the ball seat body proximate and uphole of the one more or more first fluid bypass ports, a second circumferential seal located between the sheer sleeve and the ball seat body proximate and downhole of the one more or more first fluid bypass ports, and a third circumferential seal located between the sheer sleeve and the ball seat body proximate and downhole of the one more or more second fluid bypass ports.

11. A well system, comprising:

a casing string secured within a wellbore extending through one or more subterranean formations;

a liner hanger and liner string suspended from and proximate a downhole end of the casing string; and a ball seat release apparatus coupled proximate a downhole end of a running tool, and positioned within at least a portion of the liner hanger or liner string, the ball seat release apparatus including:

a shear sleeve, the shear sleeve having a recess pocket located along a portion of an inner surface thereof, the shear sleeve further including a downhole shoulder configured to engage with a shoulder in a crossover sub the shear sleeve is configured to slide within; and a ball seat body slidingly engaged within the shear sleeve, the ball seat body configured to move from a first linear position to a second linear position in relation to the shear sleeve, and further wherein a shear feature releasably couples the ball seat body with the shear sleeve, the ball seat body including:

a longitudinal fluid passageway;

a ball seat located in the longitudinal fluid passageway;

one or more first fluid bypass ports coupling the longitudinal fluid passageway and an exterior of the ball seat body, the one or more first fluid bypass ports located on a first side of the ball seat; and one or more second fluid bypass ports coupling the longitudinal fluid passageway and the exterior of the ball seat body, the one or more second fluid bypass ports located on a second opposing side of the ball seat.

12. The well system as recited in claim 11, wherein the shear sleeve includes a locking snap feature.

13. The well system as recited in claim 12, wherein the recess pocket is a first recess pocket, and further wherein the ball seat body includes a second recess pocket located along a portion of an outer surface thereof, the locking snap feature configured to radially retract into the second recess pocket to lock the ball seat body and the shear sleeve relative to one another when the ball seat body is in the second linear position.

14. The well system as recited in claim 11, wherein the recess pocket, one or more first fluid bypass ports, and one or more second fluid bypass ports are configured to provide a fluid flow path around a drop ball or plug engageable with the ball seat when the ball seat body is in the second linear position.

15. The well system as recited in claim 14, wherein a distance (D) between the one or more first fluid bypass ports and the one or more second fluid bypass ports is greater than a width (W) of the recess pocket.

16. The well system as recited in claim 15, wherein the ball seat body has a first outer diameter ($d_1$) proximate the one or more first fluid bypass ports and a second lesser outer diameter ($d_2$) proximate the one or more second fluid bypass ports.

17. The well system as recited in claim 16, wherein the one or more first fluid bypass ports do not radially align with the recess pocket when the ball seat body is in the first linear position, but the one or more second fluid bypass ports do radially align with the recess pocket when the ball seat body is in the first linear position, and the one or more first fluid bypass ports do radially align with the recess pocket when the ball seat body is in the second linear position, but the one or more second fluid bypass ports do not radially align with the recess pocket when the ball seat body is in the second linear position.

18. A method for completing a well system, comprising:

deploying a liner hanger and liner string within a casing string using a running tool, wherein a ball seat release apparatus is coupled proximate a downhole end of the running tool, the ball seat release apparatus including:

a shear sleeve, the shear sleeve having a recess pocket located along a portion of an inner surface thereof, the shear sleeve further including a downhole shoulder configured to engage with a shoulder in a crossover sub the shear sleeve is configured to slide within; and a ball seat body slidingly engaged within the shear sleeve, the ball seat body configured to move from a first linear position to a second linear position in relation to the shear sleeve, and further wherein a shear feature releasably couples the ball seat body with the shear sleeve, the ball seat body including:

a longitudinal fluid passageway;

a ball seat located in the longitudinal fluid passageway;

one or more first fluid bypass ports coupling the longitudinal fluid passageway and an exterior of the ball seat body, the one or more first fluid bypass ports located on a first side of the ball seat; and one or more second fluid bypass ports coupling the longitudinal fluid passageway and the exterior of the ball seat body, the one or more second fluid bypass ports located on a second opposing side of the ball seat;

positioning the liner hanger proximate a downhole end of the casing string;

placing a drop ball or plug within the casing string, the drop ball or plug seating against the ball seat; and pressuring up on the drop ball or plug seated against the ball seat to set the liner hanger and fix the liner string relative to the casing string, and then moving the running tool downhole to move the ball seat body from the first linear position to the second linear position and provide a fluid path downhole of the ball seat release apparatus.

19. The method as recited in claim 18, wherein moving the running tool downhole to move the ball seat body from the first linear position to the second linear position includes:

moving the shear sleeve and the ball seat body downhole until the downhole shoulder of the shear sleeve engages with the shoulder of the crossover sub, the shear sleeve and ball seat body linearly coupled with one another via the shear feature; and continuing to move the ball seat body downhole until the shear feature shears and allows the ball seat body to move from the first linear position to the second linear position.

20. The method as recited in claim 19, wherein continuing to move the ball seat body downhole until the shear feature shears and allows the ball seat body to move from the first linear position to the second linear position, includes aligning the one or more first fluid bypass ports with the recess pocket.

* * * * *